US008506234B2

(12) United States Patent
Brooks et al.

(10) Patent No.: US 8,506,234 B2
(45) Date of Patent: Aug. 13, 2013

(54) DUCT WALL FOR A FAN OF A GAS TURBINE ENGINE

(75) Inventors: Richard V Brooks, Derby (GB); Kenneth F Udall, Ilkeston (GB); Richard G Stretton, Loughborough (GB)

(73) Assignee: Rolls-Royce PLC, London (GB)

( * ) Notice: Subject to any disclaimer, the term of this patent is extended or adjusted under 35 U.S.C. 154(b) by 523 days.

(21) Appl. No.: 12/768,041

(22) Filed: Apr. 27, 2010

(65) Prior Publication Data

US 2010/0284788 A1 Nov. 11, 2010

(30) Foreign Application Priority Data

May 5, 2009 (GB) ..... 0907580.5

(51) Int. Cl.
*F01D 21/00* (2006.01)

(52) U.S. Cl.
USPC ..... 415/9; 415/200; 415/214.1

(58) Field of Classification Search
USPC ..... 415/9, 119, 173.4, 200, 214.1
See application file for complete search history.

(56) References Cited

U.S. PATENT DOCUMENTS

| | | | | |
|---|---|---|---|---|
| 4,484,856 | A * | 11/1984 | Patacca | 415/9 |
| 4,934,899 | A | 6/1990 | Patacca | |
| 2008/0016844 | A1 | 1/2008 | Shutrump | |
| 2010/0000227 | A1 * | 1/2010 | Porte et al. | 60/796 |

FOREIGN PATENT DOCUMENTS

| | | | |
|---|---|---|---|
| EP | 1 083 300 | A2 | 3/2001 |
| EP | 1 243 797 | A2 | 9/2002 |
| EP | 1 596 037 | A2 | 11/2005 |
| GB | 2 090 334 | A | 7/1982 |
| GB | 2 365 945 | A | 2/2002 |
| WO | WO 2008/006959 | A1 | 1/2008 |

OTHER PUBLICATIONS

British Search Report issued in United Kingdom Patent Application No. GB0907580.5 on Sep. 2, 2009.
Search Report issued in European Patent Application No. EP 10 16 1135 dated Oct. 8, 2010.

* cited by examiner

*Primary Examiner* — Christopher Verdier
(74) *Attorney, Agent, or Firm* — Oliff & Berridge, PLC

(57) ABSTRACT

A duct wall of a fan casing of a gas turbine engine comprises an intake section and a containment casing, which are interconnected by bolts at flanges. An acoustic flutter damper is provided between the flanges to reduce or eliminate flutter arising in blades of the fan at certain important operating conditions. The damper provides flexibility at the connection between the intake section and the containment casing so that, in the event of detachment of a blade or a bladed fragment, the resulting deflection wave in the containment casing can be accommodated by displacement and/or deformation of the acoustic flutter damper, reducing the risk that the bolts will shear to allow the intake section and the containment casing to become detached from each other. The acoustic flutter damper may comprise a circumferential array of separate segments.

5 Claims, 2 Drawing Sheets

DUCT WALL FOR A FAN OF A GAS TURBINE ENGINE

This invention relates to a duct wall for a fan of a gas turbine engine, and is particularly, although not exclusively, concerned with a duct wall structure which minimises damage to the engine in the event of detachment of all or part of a blade of the fan.

Many current gas turbine engines, particularly for aerospace use, comprise an engine core and a ducted fan which is driven by a turbine of the engine core. The ducted fan comprises a fan rotor having an array of fan blades which rotate within a duct surrounding the fan rotor, to provide a substantial part of the thrust generated by the engine.

The duct is defined by a fan casing which has an inner wall which is washed by the gas flow through the fan and an outer wall which is a structural casing. The inner wall is a continuation of the inlet annulus and merges into the fan casing annulus at a smooth transition at the front of the fan casing.

It is known to provide measures in the fan casing to mitigate flutter of the fan blades. Flutter is a potentially damaging phenomenon in which the aerodynamic forces acting on a fan blade act together with the resilience of the fan blade to set up an oscillation in the blade. In some operating conditions of the engine, work done by the fan blades has a damping action on the oscillation, causing the oscillations to decay. In other operating conditions, however, the oscillations can increase in amplitude and the resulting stresses can be very damaging to the blade.

GB 2090334 discloses one measure for damping flutter, comprising an array of tubes which are embedded in a filler material between a casing of the fan duct and an abradable material over which the fan blades pass. The tubes form cavities which are tuned to resonate at a known troublesome flutter frequency, so that, in the event of flutter arising, the resonating air in the tubes creates pressure waves which damp the flutter of the fan blades.

It is necessary for the duct casing to be able to retain, with minimum damage, all or part of a fan blade which may become detached from the fan rotor. For this reason, duct casings are provided with containment means which are intended to absorb the energy of a detached blade or fragment, and to prevent, as far as possible, the ejection of the blade or fragment outside the engine. The duct wall defining the gas flow path thus commonly comprises a containment casing provided with containment measures, situated opposite the blade tips, so that the blade tips travel over the surface of the containment casing as the fan rotates. An intake section of the duct wall is typically rigidly secured to the containment casing, and extends forwards of the fan casing to provide an intake duct. The intake section and the containment casing are typically interconnected by bolts, which extend through abutting flanges on the intake section and the containment casing. In a fan blade off (FBO) event, the detached blade is thrown into contact with the inner face of the containment casing with considerable energy, and continues to rotate with the fan rotor, so travelling circumferentially around the duct wall. A circumferentially travelling deflection wave runs around the containment casing, and this applies substantial stress to the bolts holding the flanges together. This creates the danger that the bolts may shear, allowing the intake section of the duct wall to become detached from the containment casing, possibly enabling it to become entirely detached from the remainder of the engine. To reduce this possibility, the containment casing may have a relatively thin wall section adjacent the flange of the containment casing, allowing the containment casing to flex at the reduced wall section, to reduce the stresses imposed on the securing bolts. Nevertheless the connection between the flanges remains rigid and so the possibility of the bolts shearing remains.

According to the present invention, there is provided a duct wall for a fan of a gas turbine engine, the duct wall comprising an intake section and a containment casing which are connected together by coupling elements extending between respective faces of the intake section and the containment casing, the faces being spaced apart by an acoustic flutter damper which extends between the faces whereby radial displacement of a region of the containment casing face relative to the opposite region of the intake section face is accommodated by displacement and/or deformation of the acoustic flutter damper.

Thus, in embodiments in accordance with the present invention, the acoustic flutter damper provides an axial separation between the opposed faces of the intake section and the containment casing, enabling these faces to move radially relatively to each other in an FBO event. Since the faces are spaced apart, the coupling elements, such as bolts are able to tilt, reducing the likelihood of them shearing, so enabling the intake section and the containment casing to remain attached to each other.

The acoustic flutter damper may comprise a circumferential array of damper segments extending at least partially, and more probably entirely, around the circumference of the duct wall. Each segment may comprise a skin defining a chamber containing an internal structure which defines radially extending passages which open at a surface of the duct wall, for example through a perforated partition. The passages thus provide resonant chambers which give the fan duct wall the correct acoustic properties to avoid flutter of the blades of the fan at certain key operating conditions.

Each segment may have an external support element adapted to receive a respective one of the coupling elements. Each segment may have two of the support elements disposed on opposite circumferential sides of the segment, the support elements on each side being axially offset from each other so that bores of the respective support elements of adjacent segments are aligned to receive a common one of the coupling elements.

Each segment may have a retaining element cooperating with a formation provided in at least one of the faces of the intake section and the containment casing.

Each segment may have a flared configuration, as viewed in the axial direction of the fan, so that the segment becomes circumferentially wider in the radially inwards direction.

The internal structure of each segment may comprise interlocking or edge joined partitions which define the passages. The partitions and the skin may have drain means providing communication between the passages and the exterior of the skin.

The coupling elements may comprise releasable fasteners cooperating with flanges on which the faces are provided. Alternatively, the control elements may be formed integrally with, or otherwise permanently secured to, the intake section or the containment casing.

There may be at least fifty of the segments; in one embodiment there are fifty-seven segments.

The present invention also provides a gas turbine engine comprising a fan assembly having a duct casing including a duct wall as defined above.

For a better understanding of the present invention, and to show more clearly how it may be carried into effect, reference will now be made, by way of example, to the accompanying drawings, in which:—

Figure 1:
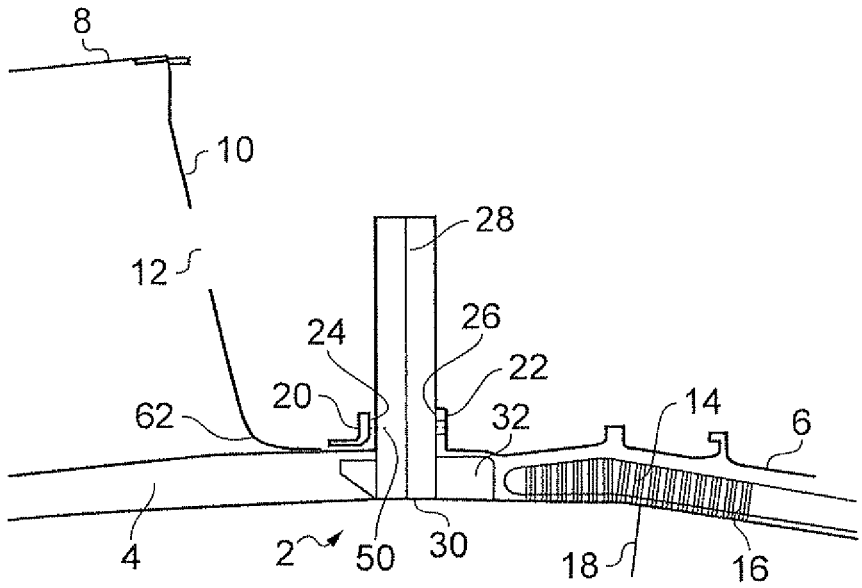
FIG. 1 is a sectional view of part of a duct casing for a fan of a gas turbine engine.

FIG. 1 shows part of a duct casing which includes a duct wall 2 comprising an intake section 4 and a containment casing 6. The intake section 4 is a twin-walled panel containing an acoustic filling (not shown) having a perforate skin on the gas-washed surface. FIG. 1 shows part of a nacelle outer cowl surface 8 which extends to the front of the duct casing (to the left in FIG. 1), and curves smoothly inwards relatively to the fan axis (which is not shown in FIG. 1 but is situated below the Figure). The cowl surface 8 is braced with respect to the intake section 4 by a sealed bulkhead partition 10 provided with an aperture 12 for passing systems.

The containment casing 6 carries a honeycomb acoustic structure 14, which is covered by an abradable coating 16 across which fan blades, represented by a leading edge 18, sweep when the engine is operating.

The intake section 4 is provided with a flange 20, and the containment casing 6 is provided with a flange 22. The flanges 20, 22 have oppositely disposed faces 24, 26, and an acoustic flutter damper 28 is positioned between these faces 24, 26. At its radially inner end 30, the acoustic flutter damper 28 projects into a cavity 32 defined between the intake section 4 and the containment casing 6, the radially inner end 30 itself terminating flush with the gas washed surfaces of the intake section 4 and the containment casing 6. The cavity 32 contains an acoustic liner structure.

The greater part of the radial extent of the acoustic flutter damper 28 projects radially outwardly of the duct wall 2. Because the acoustic flutter damper 28 is situated between the faces 24, 26 of the flanges 20, 22, the intake section 4 and the containment casing 6 are axially spaced apart from each other, rather than being directly connected together at the flanges 20, 22 as in known duct casings.

Figure 2:
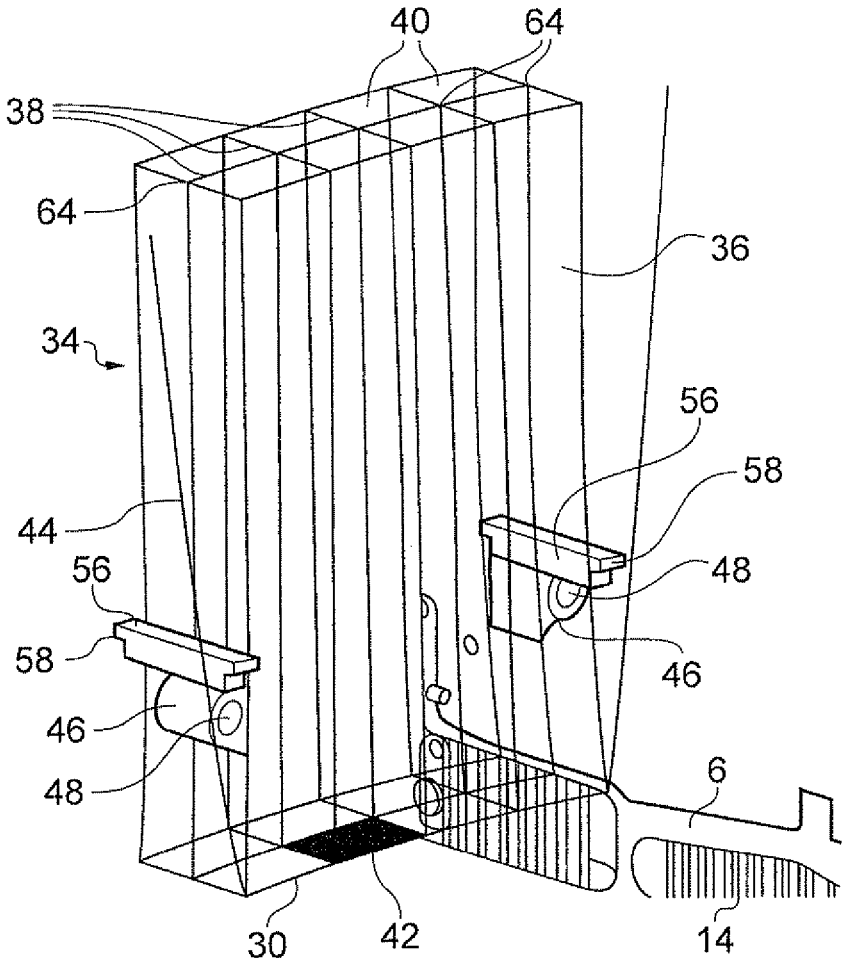
FIG. 2 shows, in schematic form, a component of the duct casing of FIG. 1.
Figure 3:
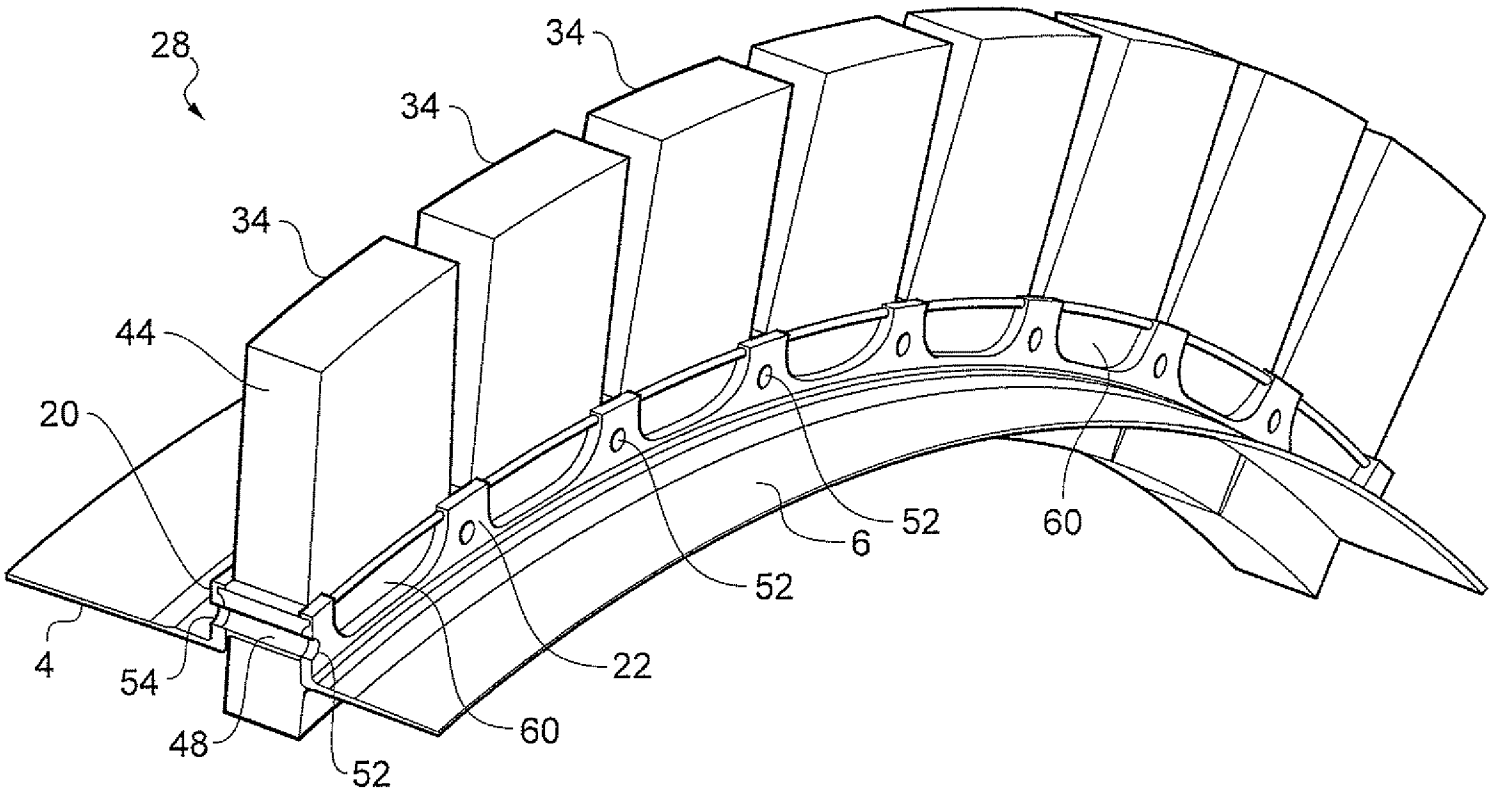
FIG. 3 is a partial perspective view of part of the duct casing shown in FIG. 1.

The acoustic flutter damper 28 is shown in more detail in FIGS. 2 and 3. It will be appreciated from FIG. 3 that the acoustic flutter damper 28 comprises an array of segments 34. The segments 34 are shown identical to each other, but are separately retained between the flanges 20, 22.

The number of segments 34 may vary in different embodiments of the invention, according to a number of factors including the size of the gas turbine engine and the sophistication of its design. In large engines, there may be more than fifty of the segments 34. For example, in the embodiment shown in FIG. 3 fifty-seven segments are arranged around the whole circumference of the duct casing; FIG. 3 therefore shows slightly less than one-seventh of the whole duct casing. In smaller or less sophisticated engines (for example, model engines) there may be far fewer segments, perhaps as few as four in some embodiments.

FIG. 2 shows one of the segments 34. Each segment 34 comprises a skin 36, within which is disposed an internal structure comprising a set of interlocking or edge-joined partitions 38 which define, within the skin 36, a series of rectangular cross-section passages which extend lengthwise of the segment 34 (i.e. radially with respect to the fan axis). In the embodiment shown, each segment is rectangular in a cross-section taken perpendicular to the radial direction, and the skin 36 extends around the rectangular periphery of the segment 34, and over the radially outer end of the segment 34.

Each passage 40 is therefore closed around its sides and at its radially outer end, and communicates at its radially inner end, through a perforated partition 42, with the interior of the duct at the face 30.

The partitions 38 and the skin 36 are provided with drain means in the form of small holes 64 which enable any water entering the segments 34 through the perforated panels 42 to drain out of the engine.

As will be appreciated from FIG. 2, the circumferential side faces 44 of each segment 34 are flared, so that they diverge from each other in the radially inwards direction. The effect of this is that, although adjacent segments 34 abut one another at their radially inner ends 30, they are spaced apart from one another at positions away from their ends 30 by a greater distance than they would be if they had a constant cross-sectional area along their length.

Each segment 34 has, on each of its circumferential side faces 44, a support element 46. The support element 46 is situated at a position approximately 20% to 30% (depending on the depth of flutter damping required but typically approximately 25-40 mm radially outboard of the casing line) along the length of the segment 34, from the radially inner end 30. Each support element 46 extends, in the axial direction, over only approximately one half of the axial width of the segment 34, and, as will be appreciated from FIG. 2, the support elements 46 on opposite sides of the segment 34 are axially offset from each other so that the one further to the left as seen in FIG. 2 is positioned towards the containment casing 6, while the one further to the right in FIG. 2 is situated towards the intake section 4. Each support element 46 has a bore 48.

When the segments 34 are assembled together as shown in FIG. 3, the support elements 46 of adjacent segments 34 fit together one behind the other in the axial direction, so that the bores 48 of the two support elements 46 are aligned. The aligned bores 48 receive coupling elements in the form of bolts (identified by centrelines 50 in FIG. 1) which pass through openings 52 in the flange 22, through the aligned bores 48 and through an opening 54 in the flange 20. The bolts 50 thus hold together the flanges 20, 22 and consequently the intake section 4 and the containment casing 6, while passing between adjacent segments 34 of the acoustic flutter damper 28.

Each segment 34 is also provided on its circumferential side faces 44 with a retaining element 56, which may be formed integrally with the support element 46. Each retaining element 56 has a pair of oppositely directed lugs 58 which project axially beyond the periphery of the segment 34. As shown in FIG. 3, the lugs 58 engage grooves formed in the flanges 20, 22, and serve to retain the segments 34 in the radial direction with respect to the intake section 4 and the containment casing 6.

It will be appreciated from FIG. 3 that the flange 22 is scalloped by means of cut-away regions 60 between the regions of the flange 22 in which the openings 52 are provided. This configuration of the flange 22 is for weight-saving reasons, and a similar configuration may be employed for the flange 20.

In operation of the engine, the fan blades 18 rotate within the duct defined by the duct wall 2, with the tips of the fan blades 18 sweeping across the abradable coating 16. Acoustic noise at audible wavelengths generated by the fan is absorbed in the filling of the intake section 4 and the acoustic structure in the cavity 32. If incipient flutter develops, the fluttering blades 18 generate low frequency pressure waves which are propagated forwards, i.e. to the left in FIG. 1, and enter the segments 34 of the acoustic flutter damper 28 through the perforated partition 42. The pressure waves thus travel up the individual passages 40 which are tuned, by adjustment of their length, in accordance with the expected frequency of the vibration experienced at the blades 18. When the acoustic properties of the elements are chosen correctly, the pressure waves which emanate from the acoustic flutter damper 28, and travel back towards the fan, generate an unsteady force on the fan which has the correct phase to oppose the flutter vibrations. Acoustic flutter dampers of the kind shown in the Figures are referred to as "deep liners" by virtue of the substantial length of the passages 40, by comparison with the shorter passages in the acoustic liner 4 and the cavity 32, which are accommodated in the relatively shallow space between the inner and outer skins of the intake section 4 and the front of the containment casing 6.

If a fan blade 18, or a fragment of such a blade, becomes detached from the rotor, it will be impelled outwardly under centrifugal force, and will pass through the abradable lining 16 into the honeycomb acoustic structure 14. Since an ejected blade or fragment will have a significant component of momentum in the circumferential direction, it will travel around the containment casing 6, generating a circumferential deflection wave of significant amplitude. In other words, the containment casing 6 is deflected radially outwardly to a substantial extent, and the flange 22 will be locally deflected relatively to the flange 20. This movement is accommodated by the spacing between the flanges 20, 22, which enables the bolts 50 to move from the generally axial alignment shown in FIG. 1 to an inclined alignment. Because the bolts 50 extend through the aligned bores 48, the segments 34 at the region of deflection will be tilted so that their radially outer ends move forwardly (to the left in FIG. 1). Thus, the deflection of the containment casing 6 caused by the ejected blade or fragment causes displacement of the segment or segments 34 in the region of the deflection, avoiding shearing of the bolts 50. Consequently, the intake section 4 and the containment casing 6 remain attached to each other by the bolts 50.

In the case of large deflections, the segments 34 in the region of the deflection may be crushed or expanded as well as being tilted. Such deformation of the segments 34 absorbs some of the energy transferred from the dislodged blade 18 or fragment and, again, reduces the possibility of destruction of the bolts 50.

The torsional stiffness of the segments 34 can be adjusted by appropriate design to provide load transference during deflection of the containment casing 6. Since a detached blade or fragment creates a travelling deflection wave, adjacent bolts 50 will be deflected at different angles from each other, causing the segments 34 between them to be twisted. If the segments 34 are of adequate torsional stiffness, they will thus transfer deflection loads from one bolt 50 to the next so reducing local bolt bending.

The tolerance and profile between the lugs 58 and the grooves in flanges 22 and 24 can be adjusted to allow the interlocking segments to rotate to some extent around the bolt centreline 50 and therefore allow the individual segments to follow the local deflection wave which passes around the circumference of the flange during an FBO event.

Thus, the individual segments 34 are connected by the bolts 50 passing through the bores 48, 52, 54, like the links in a bicycle chain, so that the travelling wave from the FBO impact raises and lowers the segments individually, causing them to locally roll about the bolt axes, and "ride" the wave. The deep liner thus has a low hoop bending stiffness, and does not try to "fight" the FBO wave. The gaps shown at the outer radius between the segments 34 open and close as the wave passes, and should be sufficient to avoid the segments "chocking" against each other, at the troughs of the wave.

It will be appreciated that the panel 10 meets the intake section 4 at a smooth curve 62 of relatively large radius. This curve enables the intake section 4 to deflect relatively to the skin 8 in a manner which minimises damage to other parts of the duct case under the deflections which occur during an FBO event.

In a particular embodiment, the radial length of each passage 40 may be approximately 250 mm and its axial width between the flanges 20, 22 may be approximately 50 mm.

It will be appreciated that the flared configuration of the circumferential side faces 44 of each segment 34 means that adequate space is provided between adjacent segments 34 to accommodate relatively larger-diameter bolts 50 at a given radial position than would be the case if the circumferential side faces 44 of each segment 34 were straight and parallel to each other. Also, it is advantageous for the bolts to be situated outside the skin 36, to avoid interference with the pressure waves generated within the passages 40. The positioning of the acoustic flutter damper 28 between the flanges 20 and 22 provides the advantage that the inlet to the passages 40, at the perforated partition 42, is positioned relatively close to the blades 18, where the energy to be damped is generated. Furthermore, the acoustic flutter damper segments 34 are able to project radially, with little constraint on the radial length of the passages 40, enabling proper tuning of the damper 28 to the frequencies expected during flutter of the blades 18.

In the event that any of the segments 34 are damaged, it is possible to replace them individually, without needing to replace the entire acoustic flutter damper 28. This consequently reduces repair and maintenance costs, as well as transportation costs, since the individual segments 34 can be packed in relatively small containers, whereas a complete acoustic flutter damper has a substantial diameter, and would require specialised handling.

The invention claimed is:

1. A duct wall for a fan of a gas turbine engine, the duct wall comprising an intake section and a containment section which are connected together by coupling elements extending between respective faces of the intake section and the containment section, the faces being spaced apart by an acoustic flutter damper which extends between the faces, whereby radial displacement of a region of the containment section face relative to the opposite region of the intake section face is accommodated by displacement and/or deformation of the acoustic flutter damper, wherein the acoustic flutter damper comprises a circumferential array of damper segments and each damper segment comprises a skin defining a chamber containing an internal structure defining radially extending passages which open at a surface of the duct wall through a perforated partition.

2. A duct wall as claimed in claim 1, wherein the internal structure comprises interlocking or edge joined partitions which define the passages.

3. A duct wall as claimed in claim 2, wherein drain means provides communication between the passages and the exterior of the skin.

4. A duct wall for a fan of a gas turbine engine, the duct wall comprising an intake section and a containment section which are connected together by coupling elements extending between respective faces of the intake section and the containment section, the faces being spaced apart by an acoustic flutter damper which extends between the faces, whereby radial displacement of a region of the containment section face relative to the opposite region of the intake section face is accommodated by displacement and/or deformation of the acoustic flutter damper, wherein the acoustic flutter damper comprises a circumferential array of damper segments, and each segment has a retaining element engaging a circumferential groove in at least one of the faces of the intake section and the containment section.

5. A duct wall for a fan of a gas turbine engine, the duct wall comprising an intake section and a containment section which are connected together by coupling elements extending between respective faces of the intake section and the containment section, the faces being spaced apart by an acoustic flutter damper which extends between the faces, whereby radial displacement of a region of the containment section face relative to the opposite region of the intake section face is accommodated by displacement and/or deformation of the acoustic flutter damper, wherein the acoustic flutter damper comprises a circumferential array of damper segments;

each segment has an external support element for receiving a respective one of the coupling elements; and each support element is provided with a bore for receiving the respective coupling element, opposite circumferential sides of each segment having respective support elements which are axially offset from each other whereby bores of the support elements of adjacent segments are aligned to receive a common one of the coupling elements.

* * * * *